United States Patent [19]

Kii

[11] 4,221,943

[45] Sep. 9, 1980

[54] GAS-BLAST TYPE CIRCUIT INTERRUPTER

[75] Inventor: Masami Kii, Amagasaki, Japan

[73] Assignee: Mitsubishi Denki Kabushiki Kaisha, Tokyo, Japan

[21] Appl. No.: 889,551

[22] Filed: Mar. 23, 1978

[30] Foreign Application Priority Data

| | | | |
|---|---|---|---|
| Mar. 24, 1977 | [JP] | Japan | 52-32905 |
| Mar. 24, 1977 | [JP] | Japan | 52-32907 |
| Mar. 24, 1977 | [JP] | Japan | 52-32933 |

[51] Int. Cl.[2] ..... H01H 33/70

[52] U.S. Cl. ..... 200/148 R; 200/148 B; 200/148 H

[58] Field of Search ..... 200/148 B, 148 R, 148 A, 200/148 C, 148 D, 148 E, 148 F, 148 G, 148 H, 148 J, 148 BV

[56] References Cited

U.S. PATENT DOCUMENTS

| | | | |
|---|---|---|---|
| 3,538,282 | 11/1970 | Leeds | 200/148 B |
| 4,139,752 | 2/1979 | Itai et al. | 200/148 C |

FOREIGN PATENT DOCUMENTS

| | | | |
|---|---|---|---|
| 47-29345 | 12/1972 | Japan | 200/148 B |
| 49-42465 | 4/1974 | Japan | 200/148 B |

*Primary Examiner*—J. V. Truhe
*Assistant Examiner*—Morris Ginsburg
*Attorney, Agent, or Firm*—Robert E. Burns; Emmanuel J. Lobato; Bruce L. Adams

[57] ABSTRACT

An improved self-extinguishing puffer-type circuit interrupter comprising a casing filled with an arc extinguishing gas such as $SF_6$ gas and including a pair of separable contacts, wherein the arc extinguishing fluid is pressure-raised by the energy of an electric arc, established upon the separation of the contacts, to be puffed to the arc to extinguish it. The interrupter includes means for releasing the arc extinguishing gas to the exterior of the extinguishing chamber when the pressure within the pressure-raising chamber in which the gas is pressurized by the arc energy reaches a certain value. The interrupter may include a valve, disposed between the pressure-raising chamber and the arc extinguishing chamber, adapted to open only when the pressure in the pressure-raising chamber is less than that above-mentioned certain pressure value.

3 Claims, 6 Drawing Figures

GAS-BLAST TYPE CIRCUIT INTERRUPTER

BACKGROUND OF THE INVENTION

1. Field of the Invention

This invention relates to puffer-type circuit interrupters and more particularly to puffer-type circuit interrupters having a pair of separable contacts disposed within a casing containing an arc extinguishing fluid and arranged to extinguish the electric arc with a puff of the arc extinguishing gas highly pressurized by the energy of the arc established upon the separation of the contacts.

2. Description of the Prior Art

In a circuit interrupter using an arc extinguishing fluid, it is an effective measure for improving the arc extinguishing capability of the interrupter to puff an arc extinguishing fluid to an electric arc to diffuse and cool the arc. In order to obtain a strong puff of the arc extinguishing gas, it is necessary to provide means for establishing a substantial pressure difference between both ends of the arcing region. The typical circuit interrupter of this type includes a puffer-type circuit interrupter wherein the pressure difference is obtained by a puffer structure operable in response to the contact opening operation and a double pressure type wherein a separate high pressure source driven by a compressor supplies the necessary high pressure gas through a valve mechanism operable in response to the contact opening operation.

However, since the puffer-type circuit interrupter must operate the puffer mechanism by a mechanical means in response to the contact opening operation, the operating force must be large. This operating force increases with the increase in the capacity of the interrupter because the puffer device increases its size as the choking arc current of the electric arc increases. With the larger operating mechanism, the mechanical strength requirement of the mechanical linkage for transmitting the operating force becomes more severe. Further, since the puffer load is very small in the unloaded or small current opening operation which is most of the contact opening operation, when the interrupter is operated under such conditions a large excessive operating force is generated due to the mechanism designed to provide a massive operating force necessary for high current interruption. This excessive force accelerates the contact at an abnormal rate to such an extent that current shearing and the generation of abnormal voltage is observed, leaving many difficult problems from practical and economical points of view.

The double pressure type circuit interrupter requires double pressure systems, and many associated devices such as valves and compressors and controls therefor, making the overall structure of the interrupter large-sized and complicated.

It has recently been proposed to utilize the pressure-raising function of the electric arc mainly due to the thermal energy of the arc itself to provide a high pressure gas, which gas is released through the arcing region to the established electric arc during the decrease of the arc current to the zero value, thereby extinguishing the arc. With this type of interrupter, since the high pressure gas is formed mainly owing to the thermal energy of the arc, the generated high pressure gas is naturally also at a high temperature. When the arc extinguishing gas is hot, it has a low density, promotes ionization, and is of deteriorated insulating capability and decreased arc diffusion and cooling function, thereby rendering its arc extinguishing function substantially degraded. This phenomenon is aggravated when an attempt is made to improve the performance by increasing the pressure-raising effect to generate a higher pressure because the higher pressure is always accompanied by a higher temperature which makes the gas have a higher conductivity, thus degrading the arc extinguishing capability of the arc extinguishing gas. This makes the interrupter disadvantageous in that it has a limit to improving the arc extinguishing performance so that a large-capacity circuit interrupter is very difficult to obtain.

SUMMARY OF THE INVENTION

Accordingly, an object of the present invention is to provide a circuit interrupter having an improved arc extinguishing capability with a simple structure.

Another object of the invention is to provide a circuit interrupter wherein the pressure of the arc extinguishing fluid is limited not to exceed a predetermined value to maintain a good insulating capability of the arc extinguishing gas.

With the above objects in view, the present invention resides in a circuit interrupter comprising means for releasing excess pressure of an arc extinguishing gas from a pressure-raising chamber such as a combination of a pressure valve and a spring or a combination of a movable nozzle and a spring. In addition to limiting the pressure rise of the arc extinguishing gas within the chamber, unnecessary pressure decrease in the arc extinguishing chamber may be prevented from taking place by providing between the pressure-raising chamber and the arc-extinguishing chamber a valve adapted to open only when the gas pressure in the pressure-raising chamber is less than a predetermined pressure value.

BRIEF DESCRIPTION OF THE DRAWINGS

The present invention will become more readily apparent from the following description of the preferred embodiments of the present invention taken in conjunction with the accompanying drawings, in which.

DESCRIPTION OF THE PREFERRED EMBODIMENTS

Figure 2:
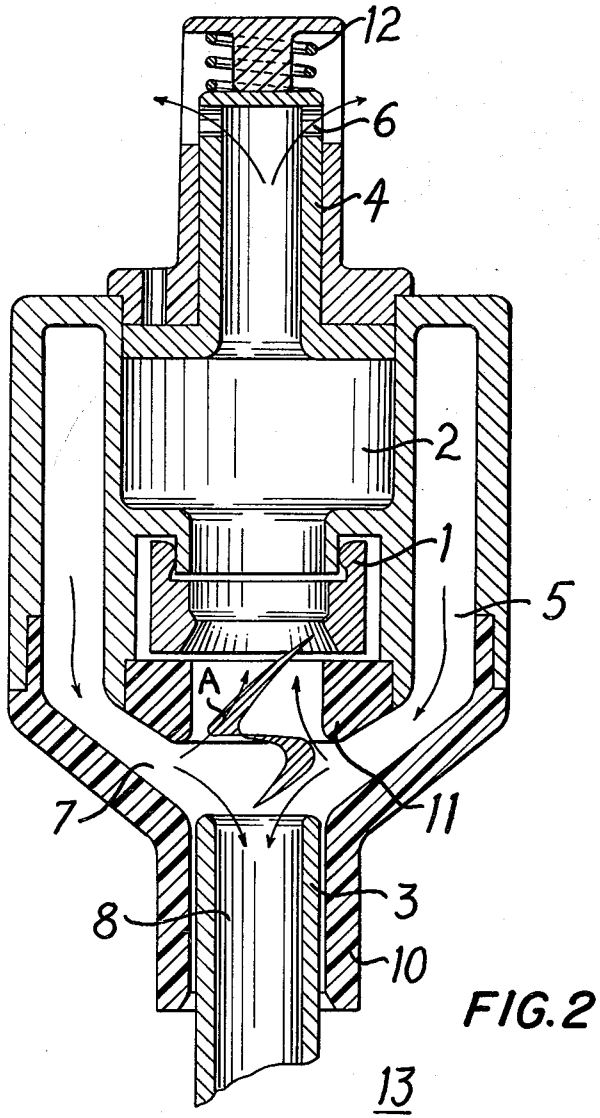
FIG. 2 is a schematic sectional view illustrating the circuit interrupter shown in FIG. 1 in its contact open position.
Figure 1:
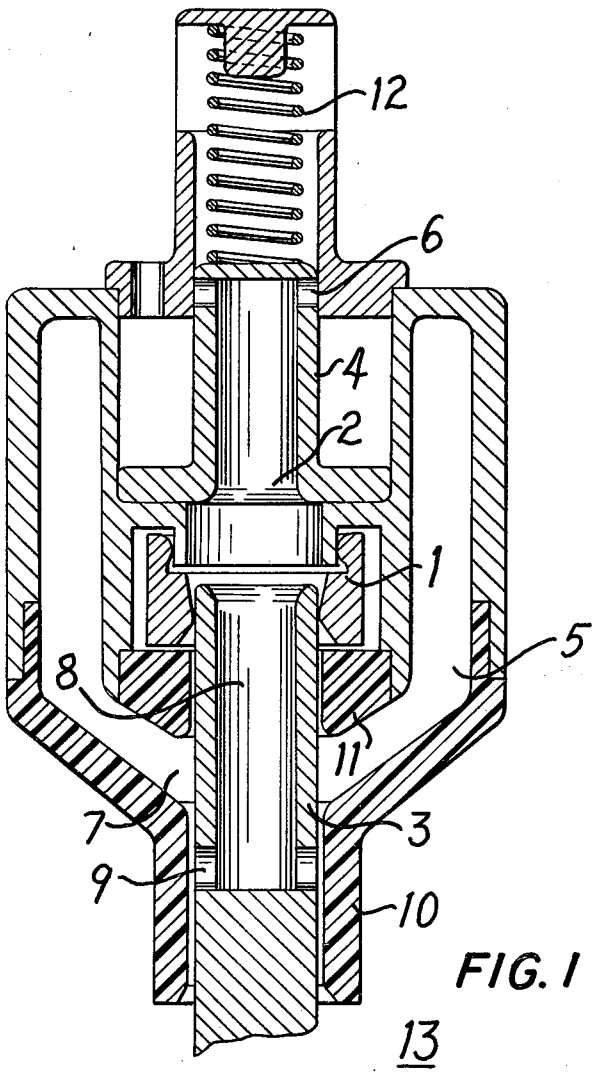
FIG. 1 is a schematic sectional view illustrating the circuit interrupter of the present invention in its closed position.

Referring now to the drawings and in particular to FIGS. 1 and 2 thereof, a circuit interrupter of the present invention comprises a pressure-raising chamber 2 having disposed therein a stationary contact 1 and containing an arc extinguishing gas such as $SF_6$ gas, a movable contact 3 operable by a well-known operating mechanism (not shown) to contact and separate from the stationary contact 1, a movable nozzle 4 operable in response to the pressure-rise in the pressure-raising chamber upon separation of the movable contact 3 from the stationary contact 1, and an arc extinguishing chamber 5 having an opening 7 facing the arcing region. The movable nozzle 4 has formed therein an opening 6 for communicating the interior of the pressure-raising chamber 2 to the interior space 13 of the casing when the movable nozzle 4 reaches its limit of movement. An orifice 11 formed of an insulating material is provided for closing the arc extinguishing chamber 2 for a short period of time to maintain the initial pressure and then open the arc extinguishing chamber 2 after the movable contact 3 is separated from the stationary contact 1. Another orifice 10 is also provided for closing a opening 9 of the nozzle 8 upon separation and thereafter communicating the arc extinguishing chamber 5 to the interior space of the casing. The movable nozzle 4 is biased by an operation spring 12 toward the movable contact 3.

When the unillustrated operating mechanism is operated, the movable contact 3 connected to the operating mechanism moves downward and after the movable contact covers a predetermined wiping distance, the contacts 1 and 3 separate from one another to establish an electric arc therebetween.

When the current to be interrupted is high and the pressure within the pressure-raising chamber 2 is high, the pressure in the pressure-raising chamber 2 causes the movable nozzle 4 to move upward against the spring force of the compression spring 12, thereby communicating the pressure-raising chamber 2 to the interior space 13 of the casing through the opening 6 as illustrated in FIG. 2. During this operation of the interrupter, the movable contact 3 continues to move downward to extend the electric arc A and increase the pressure within the arc extinguishing chamber 5. Further downward movement of the movable contact 3 causes the opening 9 to open to the interior space 13 of the casing, thereby releasing the high pressure gas in the arc extinguishing chamber 5 in upward and downward directions through the arcing region as the arc current decreases to zero, whereby the arc is extinguished by the strong diffusing and cooling function of the high pressure arc extinguishing gas. Arrows in FIG. 2 indicate the direction of the arc extinguishing gas flows.

When the interrupting current is small and the pressure-rise in the pressure-raising chamber 2 is low, the movable nozzle 4 does not move because the pressure exerted on the nozzle 4 cannot overcome the spring force of the compression spring 12, whereby the inner space of the pressure-raising chamber 2 remains small. Therefore, the pressure within the small-volume pressure-raising chamber 2 is effectively increased with a small arc energy, enabling arc extinction at the zero current point upon its release from the pressure-raising chamber 2, through the arc extinguishing chamber 5 into the interior space 13 of the casing.

Under the circumstances where the movable nozzle 4 stays at the midpoint of its stroke and the opening 6 is not opened, the movable nozzle 4 is moved downward by the compression spring 12 upon opening of the arc extinguishing chamber 2 to compensate for the pressure in the pressure-raising chamber 2 to maintain the desired pressure. Therefore, the interrupter of the present invention exhibits an excellent arc extinguishing capability even with a small current. When a massive current is to be interrupted, the arc extinguishing fluid in the pressure-raising chamber 2 is expelled after the interruption, so that the circuit interrupter exhibits stable arcing time characteristics even under severe repeated operation such as rapid reclosing.

Figure 3:
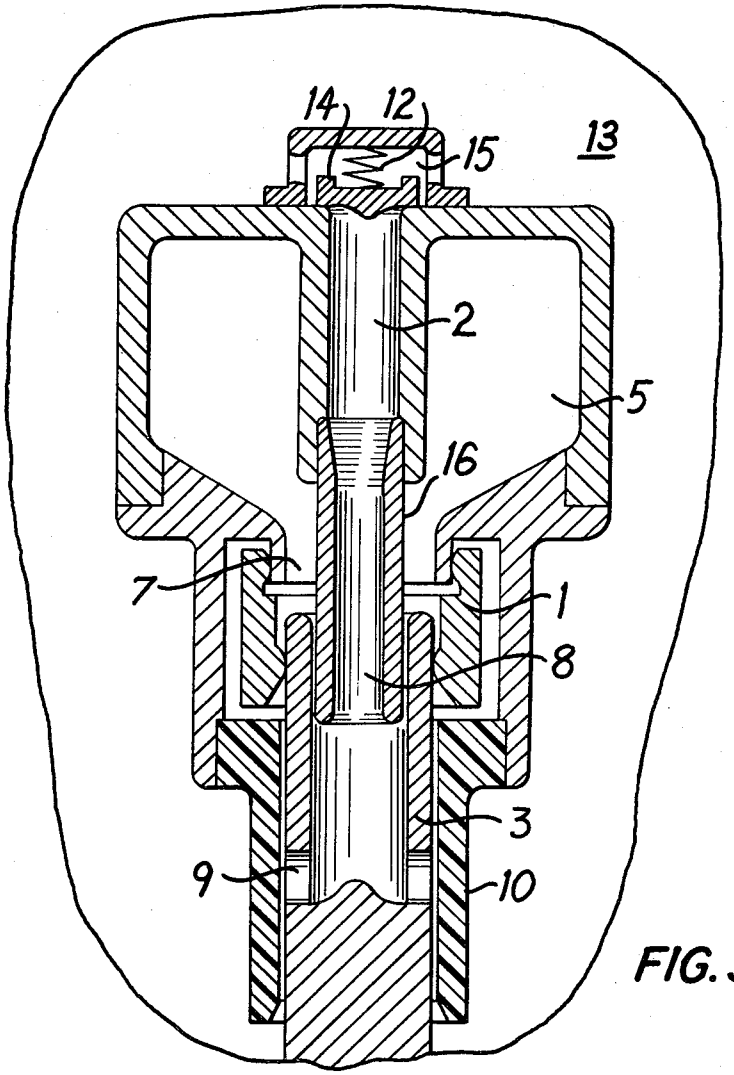
FIG. 3 is a schematic sectional view showing another embodiment of the circuit interrupter of the present invention.

FIG. 3 illustrates another circuit interrupter embodying the present invention, wherein a pressure valve 15 composed of a compression spring 12 and a valve main body 14 is provided as pressure release means for releasing the arc extinguishing fluid from the pressure-raising chamber 2. The circuit interrupter shown in FIG. 3 also comprises an arc contact 16 to which the arc established between the movable contact 3 and the stationary contact 1 is transferred upon the contact opening operation. When transferred, the electric arc moves to a location between the movable contact 3 and the arc contact 16.

The operation of the circuit interrupter shown in FIG. 3 is the same as that of the circuit interrupter illustrated in FIGS. 1 and 2 except that the arc extinguishing fluid is released into the interior space of the casing through the pressure valve 15.

Figure 4:
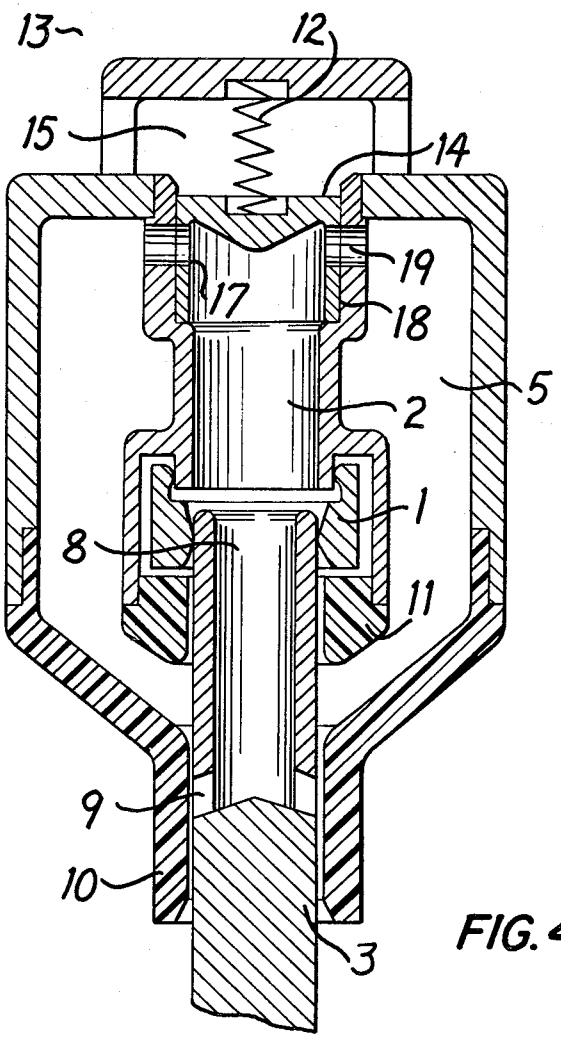
FIG. 4 is a schematic sectional view showing still another embodiment of the circuit interrupter of the present invention.

Still another embodiment of the circuit interrupter of the present invention is illustrated in FIG. 4, wherein the illustrated circuit interrupter comprises a valve main body 14 and a compression spring 12 which constitute means for expelling the arc extinguishing fluid at a pressure exceeding a predetermined value from the pressure-raising chamber 2. The pressure-raising chamber 2 also comprises a valve 18 capable of being operated by the pressure in the pressure chamber 2 against the predetermined spring force when an arc current is high enough to abnormally increase the pressure in the pressure-raising chamber 2, thereby releasing the pressure within the pressure-raising chamber 2 as well as subsequently releasing the high pressure arc extinguishing fluid from an opening 17 of the valve 18.

Figure 5:
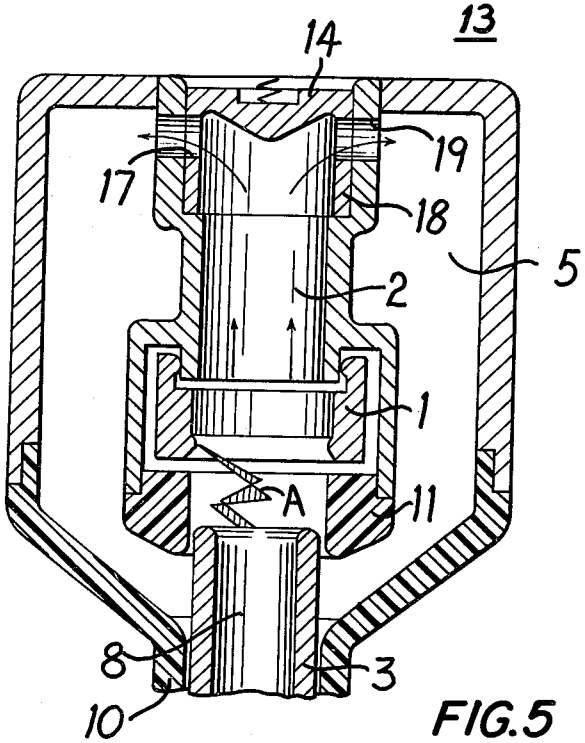
FIG. 5 is a schematic sectional view showing the circuit interrupter shown in FIG. 4 in its contact open position.
Figure 6:
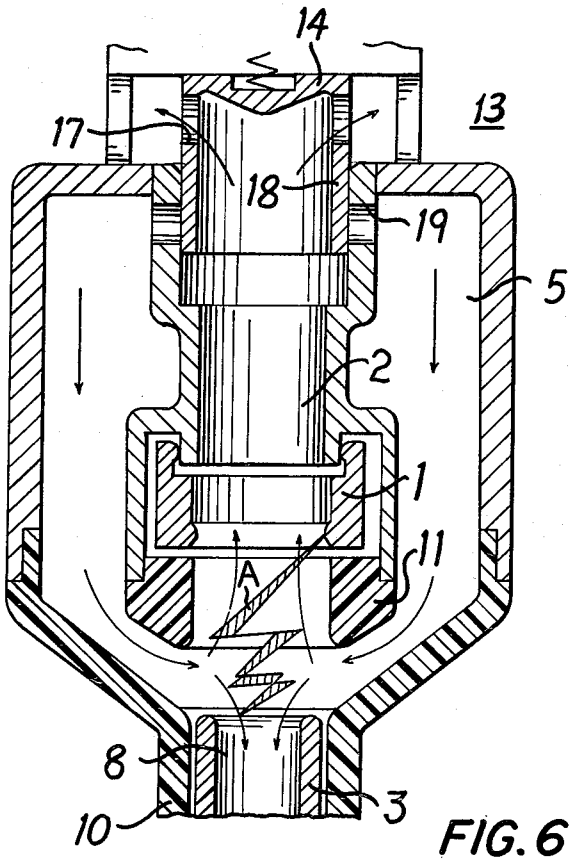
FIG. 6 is a view similar to FIG. 5, but illustrating the contact position at a later time.

When the unillustrated operating mechanism is driven, the movable contact 3 moves downward to cover the wiping distance to separate from the stationary contact 1, thereby establishing an electric arc A therebetween as shown in FIG. 5. This arc heats and expands the arc extinguishing fluid within the pressure-raising chamber 2 to increase its pressure and the high pressure gas flows into the arc extinguishing chamber 5 through the flow path 19. Further downward movement of the movable contact 3 extends the electric arc to increase the arc input, thereby causing the pressure-raising function of the arc to further increase, which consequently increases the pressure within the pressure-raising chamber 2. Further increase in the pressure within the pressure-raising chamber 2, above a predetermined value causes the valve 18 to move beyond the predetermined stroke to move the valve main body 14 upward against the compression spring 12, thereby releasing the pressure in the pressure-raising chamber 2 through the opening 17 into the interior space 13 of the casing as shown in FIG. 6.

Since the valve 18 releases only the pressure exceeding the predetermined value to the interior space 13, the pressure-raising continues to take place within the arc extinguishing chamber 5. Arrows shown in FIG. 6 indicate the flow directions of the arc extinguishing fluid. Therefore, the necessary pressure in the arc extinguishing chamber 5 is always maintained. This operation is kept until the nozzle opening 9 communicates with the arc extinguishing chamber 5 through the nozzle 8 by the further downward movement of the movable contact 3.

If the arc current is large enough and the valve 18 is open to the interior space 13 of the casing when the nozzle opening 9 is open to the arc extinguishing chamber 5, the pressure-rising function of the electric arc decreases during the arc current decreasing periods of the pulsating arc current, the pressure in the arcing region is rapidly decreased, allowing the high pressure fluid within the arc extinguishing chamber 5 to flow into the arcing region against the decreased pressure in the arcing region. Therefore the arcing region is opened in two directions, thereby effectively diffusing and cooling the arc to quickly extinguish it. When the arc current is relatively small and the pressure is not high enough to operate the valve 18, the high pressure arc extinguishing fluid stored within the arc extinguishing chamber 5 is effectively released to the interior space of the casing through the nozzle opening 9 for a predetermined period of time, providing a reliable arc extinguishing performance.

As is apparent from the foregoing description, the circuit interrupter constructed in accordance with the present invention needs only a small operating force and exhibits an excellent arc extinguishing performance over a wide range of electric current values with a compact structure.

What is claimed is:

1. A self-extinguishing gas-blast type circuit interrupter, comprising:

a casing containing an arc extinguishing gas in use;

means for defining an arc extinguishing chamber within said casing and containing an arc extinguishing gas in use, said arc extinguishing chamber having an opening in communication with the interior of said casing;

a pressure chamber disposed adjacent to said arc extinguishing chamber and having an opening opposite the opening of said arc extinguishing chamber;

a pair of separable contacts disposed within said pressure chamber, at least one of said contacts being dimensioned to extend into and be movable through said openings of said pressure chamber and said arc extinguishing chamber;

means, disposed in said movable contact and including a nozzle and an opening, for blocking, in cooperation with said arc extinguishing chamber defining means, fluid communication from said pressure chamber and said arc extinguishing chamber to said interior of the casing until said pair of contacts separate a predetermined distance from each other, and for establishing fluid communication from said pressure and arc extinguishing chambers to said interior of said casing when the contacts separate beyond said predetermined distance during the contact opening operation; and pressure release means for releasing the arc extinguishing gas in said pressure chamber into the interior of the casing when the gas pressure within the pressure chamber exceeds a predetermined overpressure value.

2. A circuit interrupter as claimed in claim 1, wherein said pressure release means comprises: a valve for closing and opening said pressure chamber to the interior of said casing; and bias means for biasing said valve toward the closed position by a predetermined bias force.

3. A circuit interrupter as claimed in claim 2, wherein said pressure release means further includes: means for providing communication between said pressure chamber and said arc extinguishing chamber when the gas pressure within said pressure chamber is less than said predetermined value.

* * * * *